United States Patent [19]

Chamberlain et al.

[11] 4,121,536

[45] Oct. 24, 1978

[54] LABEL DISPENSING DEVICE

[75] Inventors: Ray Chamberlain, Stamford; Richard B. Smith, Ridgefield, both of Conn.

[73] Assignee: Pitney-Bowes, Inc., Stamford, Conn.

[21] Appl. No.: 749,453

[22] Filed: Dec. 10, 1976

[51] Int. Cl.[2] ..... B05C 1/02; B05C 13/02

[52] U.S. Cl. ..... 118/6; 118/236; 118/264; 221/13; 221/135

[58] Field of Search ..... 221/13, 22, 96, 135; 118/236, 264, 267, 268, 6

[56] References Cited

U.S. PATENT DOCUMENTS

| | | | |
|---|---|---|---|
| 1,766,239 | 6/1930 | Zurndorf | 118/236 X |
| 2,639,688 | 5/1953 | Procter | 118/236 |
| 3,029,979 | 4/1962 | Freeland | 221/22 |
| 3,262,418 | 7/1966 | Stephens et al. | 118/236 X |

*Primary Examiner*—Robert B. Reeves
*Assistant Examiner*—Francis J. Bartuska
*Attorney, Agent, or Firm*—Peter Vrahotes; William D. Soltow, Jr.; Albert W. Scribner

[57] ABSTRACT

A demand feed and moistening apparatus is adapted to advance successive gummed labels from a stack to a ready position at a label dispensing station from which each label may be readily manually withdrawn and thereby moistened. Thereafter the next label in said stack is automatically advanced to said ready position and remains in this position until it also is manually removed. The use of such a label dispensing and moistening arrangement greatly facilitates the manual grasping of successive moistened labels and the application thereof to items that are to labeled.

3 Claims, 5 Drawing Figures

LABEL DISPENSING DEVICE

BACKGROUND OF THE INVENTION

There are many instances where individual gummed labels must be applied to each of many items that are to be labeled. This type of task when manually performed often involves a rather tedious procedure of picking up each label, moistening the gummed surfaced thereof and then applying such to a desired surface. These operations are time consuming not only because of the significant amount of label handling involved but also because the latter usually becomes messy and somewhat hampered by the unavoidable spread of the moistened adhesive gum that accumulates on the fingers of the person performing the labeling task. Such operating conditions are prevalent for example in mailroom environments where relatively short addressing job runs require the manual application of labels to envelopes, packages and the like and where to make matters more difficult the job runs in most cases must be completed before mail-out schedule deadlines. As will be apparent there is a need in such situations for equipment that will facilitate the quick and easy manual handling and moistening of gummed labels.

SUMMARY OF THE INVENTION

In essence the present invention comprises the combination of three basic elements, namely a label feeding device, a label moistening device and an electrical control system that is operatively associated with said label feeding and moistening devices. The label feeding device used here may be one of the several commercially available units. On the discharge or downstream end of such unit there is mounted a label moistening device that includes a fluid containing tank and an associated wick or label wetting brush. The electrical control system includes a plurality of electrical switching means that are spaced along the label feed path whereby the label feeding device may be controlled so as to advance successive labels from a label stack to a ready position, the latter effectively defining a label dispensing station for the present apparatus. The leading end of a label that has been advanced to the ready position may then be grasped by the operator and the label withdrawn from the dispensing station thereby completing the moistening thereof and causing said switching means to be actuated so that the next label is automatically fed to said ready position. This demand feed type control arrangement will cause each successive label to be fed to said dispensing station whenever the label that was previously there is removed.

The primary object of the invention is to provide a novel apparatus for the efficient dispensing of moistened gummed labels.

Another object of the invention is to provide a demand feed type arrangement for label handling and moistening apparatus.

A further object of the instant invention is to provide a novel apparatus for minimizing the manual handling of gummed labels that are to be applied to the desired surfaces.

Other objects of the invention will become apparent as the disclosure progresses.

DETAILED DESCRIPTION OF THE INVENTION

Figure 2:
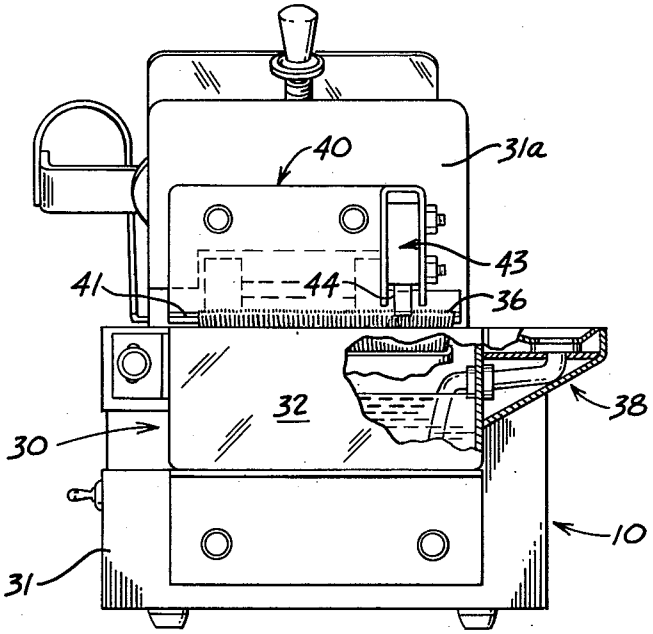
FIG. 2 is a front elevational view illustrating the apparatus shown in FIG. 1.

Referring to the drawings the label feeding device 10 of the present invention may be of any suitable known type and for the purpose of this embodiment of the invention such may be constituted by a Model 5450 letter feeder now currently being marketed by Pitney-Bowes, Inc. of Stamford, Connecticut. This unit will be briefly described with primary reference to FIGS. 1, 2 and 3. The upper portion of the feed device 10 includes a letter or label supporting tray or compartment 11 which is adapted to receive and retain a stack 12 of letters, labels or other sheets that are to be serially dispensed therefrom. The lowermost label **12*a*, FIG. 1, of the stack shown is adapted to be separated from the stack by means of a separator roll 14 and cooperating stationary stones 14*a* and advanced along a horizontal feed path, indicated by arrow 15 of FIGS. 1 and 3, to and between upper and lower cooperating feed rolls 16 and 17 respectively. The lower rolls 17 are rotatably driven through a belt and pulley arrangement (not shown) by the shaft carrying said separator roll 14. The roll 14 is adapted to be driven by means of an electric motor 20 through a normally engaged electromagnetic clutch 21, a gear set 22 and a belt and pulley arrangement 23. Extending downstream and intersecting the said feed path 15 is a control arm 25, FIGS. 1 and 3, of a normally open electrical switch 26, FIG. 1, that is carried by the frame of said label feed device 10. The above described construction and operation of the separator feeder unit 10** is entirely conventional and commercially well-known and hence further detailed discussions thereof need not be made here.

Figure 3:
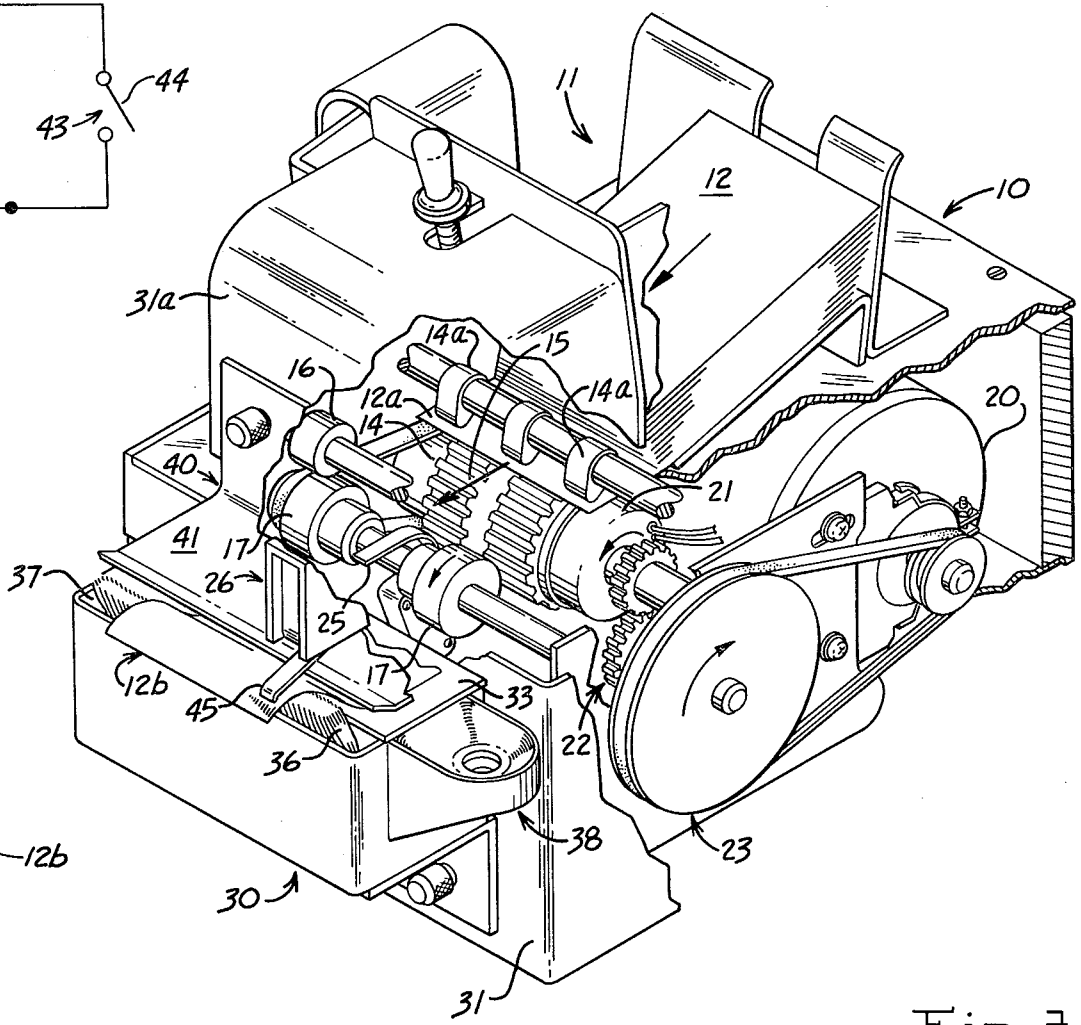
FIG. 3 is a perspective view, partially cut away, of the apparatus shown in FIGS. 1 and 2.

A label moistening device 30 is mounted by any suitable bracket means on the lower downstream end wall 31 of the label feed device 10; this moistening device including a fluid containing tank 32 having a top that is covered for the most part by a suitable plate 33, the upper surface of the latter being disposed substantially coplanar with the plane of said feed path 15. The downstream vertically disposed wall 34 of tank 32 has an upper end to which is secured by a means of a suitable bracket 35 a label wetting means comprising a wick or wetting brush 36 or the like. The lower end of the laterally elongated brush 36, FIG. 3, is immersed in the fluid (usually water) in the tank 32 while the upper end thereof extends through the narrow laterally extending opening 37 at the top of tank 32 and barely intersects the said feed path 15, the said upper brush end being capable of transferring fluid to the gummed surface of a label in a manner that is well understood in the art. If desired any suitable means such as is illustrated at 38 of FIG. 2, may be utilized for replenishing the water supply in said tank 32.

Figure 5:
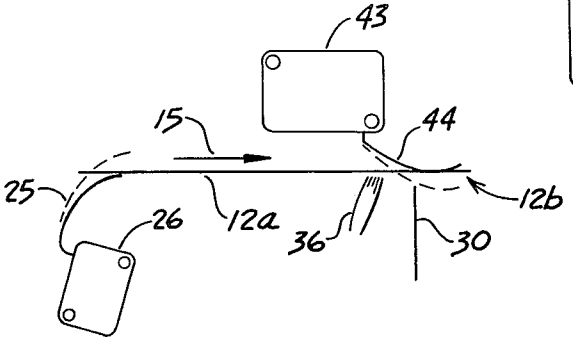
FIG. 5 is a diagramatic view illustrating the positional relationship between a label that is at the ready position and the two electrical switching means of the FIG. 4 control system.

The vertical leg of a right angle bracket 40 is secured to the upper downstream end wall 31*a* of the label feeding device 10 so that the horizontal leg 41 thereof is disposed in closely spaced parallel relation to the said cover plate 33. Plate 33 and bracket leg 41 thus afford top and bottom guide surfaces for a label that is moving along feed path 15 towards said moistening brush 36. The bracket 40 mounts a normally open eletrical switch 43 having an actuating arm 44 that has an outer end 45, FIG. 3, which intersects the said feed path 15 at a point slightly downstream from the said upper moistening end of said brush 36 as indicated in FIGS. 1, 3 and 5.

Figure 4:
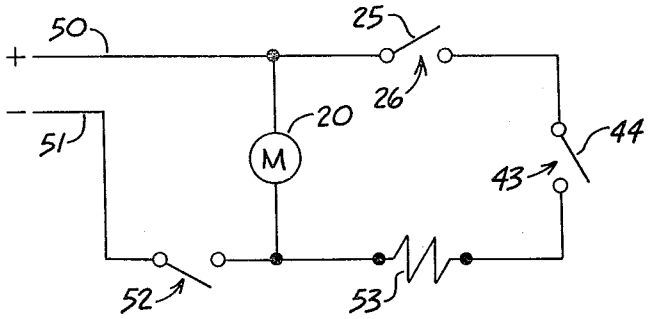
FIG. 4 is a circuit diagram illustrating the control system for the apparatus of FIGS. 1–3.

The electrical circuit for interconnecting the motor 20, clutch 21, and switches 26 and 43 is shown in FIG. 4. The motor 20 is connected across the power supply lines 50, 51, the latter having an on-off switch 52 therein. Connected across lines 50, 51 in parallel with motor 20 are the serially coupled switches 26 and 43 and the coil 53 of the electromagnetic clutch 21.

Figure 1:
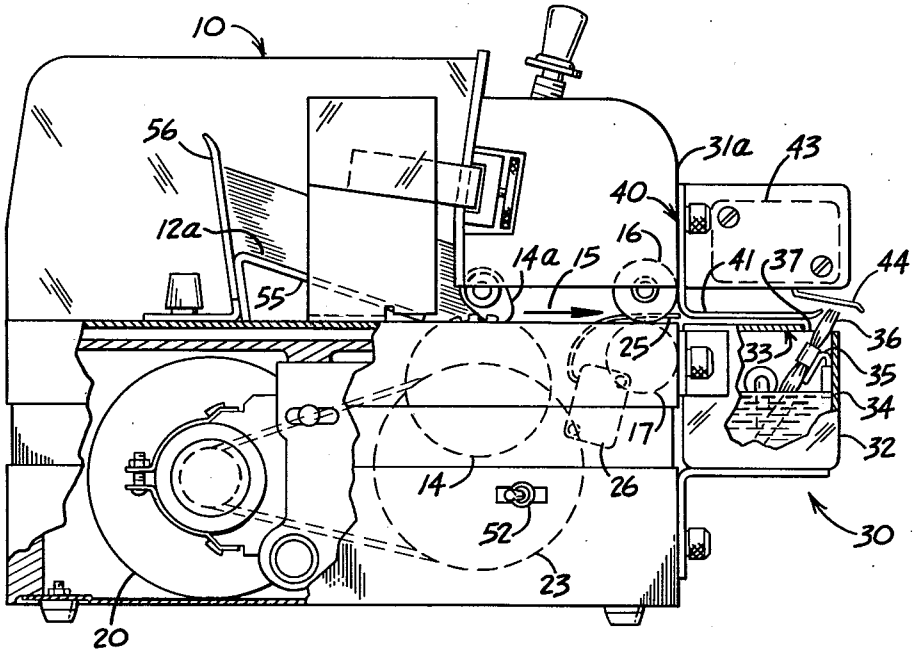
FIG. 1 is a side elevational view in partial section illustrating the construction and arrangement for the present label feeding device and label moistening device.

When as here the sheet feeding device 10 is to be used to separate and feed relative short labels the device 10 is modified slightly to include an inclined bottom ramp plate 55, FIG. 1, that is secured to the rear adjusting plate 56 of the said stack receiving tray 11 so as to support the label stack for a more efficient separation and feeding action of each successive label from the bottom of the stack.

In the operation of the instant apparatus a stack of gummed labels is loaded (gummed surface down) into the stack tray 11 after which the on-off switch 52 is turned on. The motor 20 will immediately rotatively drive the separator roll 14 through the normally engaged clutch 21 so that the lower most label 12*a* in said stack is separated and fed along said feed path 15. This label first moves past and actuates the switch arm 25 so that the normally open switch 26 becomes closed. The feed rolls 16, 17 continue the feed movement of the label 12*a* along feed path 15 so that the leading edge thereof moves past the top of brush 36 and immediately thereafter actuates the switch arm 44 thereby closing the normally open switch 43. With both switches 26 and 43 now closed the coil 53, FIG. 4, of the electromagnetic clutch 21 will be energized so as to disengage said clutch, such disengagement causing the separator roll 14 and the feed rolls 16, 17 to immediately stop advancing said label. The label 12*a* is thus arrested in a ready position as illustrated in FIGS. 3 and 5 wherein both switch arms remain actuated and the lead edge 12*b*, FIG. 3, of the label is disposed just beyond the downstream end of said moistening tank 32; that portion of the lower gummed surface of label 12*a* between the said leading edge 12*b* and the brush 36 now being moistened by said movement past the brush. This stationary disposition of the label constitutes a ready position, and effectively defines a dispensing station for each successive label. As may be seen from FIG. 5 the effective length of the label 12*a* as measured in a direction along the feed path 15 is greater than the effective distance between switches 26 and 43 thereby maintaining both switches closed when in said ready position. When the operator desires to apply the label 12*a* to an item, the extended leading end portion of the label may be grasped and the label pulled through and from the moistening device, the remaining gummed portion of the lower surface of this label then being moistened. When the label 12*a* is so withdrawn the switches 26 and 43 will be sequentially permitted to restore to their normal open positions and as soon as switch 25 is so restored the clutch coil 53 will be deenergized thus causing the separator and feed rolls to again be driven so as to initiate the separating and feeding of the next label to said ready position in a manner similar to that described above for the first label 12*a*.

As will be apparent the label dispensing function of the above described demand-feed type apparatus makes possible a serial supply at the ready position of moistened gummed labels which an operator need only successively grasp and apply at the repetitive work rate needed or desired. This capability eliminates and/or minimizes the amount of manual handling of the labels and the amount of interference in such operations by the unwanted spread of the wet label gum adhesive to unintended surfaces; and makes possible an increase in the rate that letters, packages or other items may be manually labeled.

We claim:

1. A gummed label dispensing and moistening apparatus comprising:

a label separating and feeding device adapted to serially separate gummed labels from a stack and to feed the same along a predetermined feed path to a ready position at a label dispensing station;

a fluid container tank mounted and disposed adjacent to said label dispensing station;

label wetting means received within said tank, a portion of said wetting means being disposed along said feed path so as to moisten one side of a label that is moved along said feed path and through said dispensing station; and control means including a pair of electrical switching means connected in series with one another that are mounted in spaced relation along said feed path for normally controlling the operation of said separating and feeding device so as to feed a label toward said ready position, and for interrupting the operation of said separating and feeding device when a label reaches said ready position, a label when in said ready position being capable of being manually removed therefrom and thereby moistened on one side thereof preparatory to being applied to an item that is to be labeled, and for reestablishing operation of said separating and feeding device when a label is so removed from said ready position said label separating and feeding device being disabled only when both of said switching means are operated and enabled when either one of said switching means is restored to its normally open condition.

2. Apparatus as defined by claim 1 wherein the effective length of the label being fed as measured in a direction along said feed path is greater than the effective distance between said pair of switching means.

3. Apparatus as defined by claim 1 wherein said control means includes two normally-open electrical switches, and wherein said wetting means includes a brush.

* * * * *